US006363915B1

(12) United States Patent
Cohen

(10) Patent No.: US 6,363,915 B1
(45) Date of Patent: Apr. 2, 2002

(54) FUEL INJECTOR VALVE WITH MOTION DAMPER

(75) Inventor: James H. Cohen, Virginia Beach, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/575,730

(22) Filed: Aug. 7, 2000

Related U.S. Application Data

(60) Provisional application No. 60/214,747, filed on Jun. 29, 2000.

(51) Int. Cl.[7] ..... F02M 41/00

(52) U.S. Cl. ..... 123/467; 239/533.11

(58) Field of Search ..... 123/467, 468, 123/458; 239/533.11, 533.12, 584, 585.1

(56) References Cited

U.S. PATENT DOCUMENTS

| | | | | |
|---|---|---|---|---|
| 5,829,688 A | * | 11/1998 | Rembold et al. | 239/585.1 |
| 5,875,975 A | * | 3/1999 | Reiter et al. | 239/585.1 |
| 5,915,626 A | * | 6/1999 | Awarzamani et al. | 239/135 |
| 6,012,655 A | * | 1/2000 | Maier | 239/585.4 |
| 6,227,457 B1 | * | 5/2001 | Oliver | 239/5 |

* cited by examiner

*Primary Examiner*—Henry C. Yuen
*Assistant Examiner*—Mahmoud Gimie

(57) ABSTRACT

The present invention provides a valve arrangement for metering fluid flow. The valve arrangement includes a valve seat including an orifice through which fluid flows. The valve arrangement also includes a valve displaceable along an axis between a first position contiguously engaging the valve seat and a second position spaced from the valve seat. Fluid flow between the valve seat and the valve is prevented in the first position and is permitted in the second position. The valve arrangement further includes a counterweight mounted on the valve for relative movement therebetween.

14 Claims, 3 Drawing Sheets

FUEL INJECTOR VALVE WITH MOTION DAMPER

A CROSS REFERENCE TO RELATED APPLICATIONS

Continuity Statement This invention claims the benefit of the filing date of U.S. Provisional Application No. 60/214,747, filed Jun. 29, 2000, and incorporated by reference herein in its entirety.

BACKGROUND OF INVENTION

This invention relates to fuel injectors in general and particularly to fuel injectors for Compressed Natural Gas (CNG). More particularly, this invention relates to a damping system for counteracting rebound of a valve needle during the operation of a fuel injector.

Compressed natural gas, which is a common fuel for commercial fleet vehicles, is delivered to an engine through one or more fuel injectors. Each injector is required to deliver a precise amount of fuel per injection pulse, and maintain this precision over the life of the injector. In order to maintain this level of performance for an injector, certain strategies and sequences of operations are required to optimize the combustion of the fuel.

In order to promote efficient fuel consumption, the injector is required to open and close very quickly. This is effectively accomplished using a magnetic circuit to displace the valve needle with respect to an injector outlet seat. Specifically, a magnetic field—or flux—is produced relatively quickly across a working gap between a fuel inlet member, which acts as a stator, and an armature connected to the valve needle. A conventional magnetic circuit for an injector includes the inlet member, the armature, a valve body shell, a housing (providing a flux return path), and a coil. When energized, the coil produces the flux that is conducted through the steel parts of the magnetic circuit. The flux creates an attractive (or repulsive) force at the working gap, which moves the armature and valve needle, to open (or close) the injector.

However, quickly opening the injector creates a relatively severe impact between the armature and the inlet member. And quickly closing the injector creates a relatively severe impact between the armature needle assembly and injector outlet seat. In a CNG injector, the factors that affect the injector opening and closing impact velocities are more severe than in a gasoline injector. Compared to the gasoline injector, the CNG injector has two to three times more lift, less spring preload, and a similar force required to open the injector. These factors are exaggerated by the lower viscosity of CNG relative to gasoline.

The much greater lift of the CNG injector corresponds to the need for a much higher flow rate and area in order to obtain the same amount of energy flow through the injector for a given pulse. This is because CNG has a relatively lower density than gasoline.

The increased lift creates two problems. First, the increased lift substantially reduces the magnetic force available to open the injector. Second, the velocities created because of the longer flight times can be higher, creating higher impact momentum. The reduction in magnetic force also creates another problem: it is necessary to use a lighter spring preload than in a gasoline injector.

A conventional gasoline injector uses about four Newtons of spring preload and a very small gasoline force on the needle armature assembly while the injector is closed. In a CNG injector, the force of the gas pressure is about three Newtons and the force of the spring is about two Newtons. In operation, energizing a CNG or gasoline injector causes the needle armature to begin to move when the magnetic force reaches a level that overcomes the spring and the fuel force. However, in a CNG injector, the fuel force is removed as soon as the needle/seat seal is broken and the pressure equalizes at the tip of the needle. At this point, the magnetic force is substantially higher then it needs to be to lift the armature needle assembly against the force of the spring. This excess magnetic force, combined with a relatively light spring preload, high lift, and low viscosity CNG all contribute to high impact velocities between the armature and the inlet member. Lifting the needle also allows CNG to jet out through the injector outlet seat. To close the injector outlet, the magnetic coil is de-energized. In absence of the magnetic force, the armature needle assembly travels under the bias of the spring until the needle tip contacts the injector outlet seat, thereby closing the injector. The high velocity of the armature needle assembly that culminates in the closing impact between the needle tip and the injector outlet seat can cause the armature needle assembly to rebound, which can result in an uncontrolled secondary fuel injection(s). Thus, there is a need to provide fuel injectors (compressed natural gas injectors in particular) with mechanical damping for the armature needle assembly during opening and closing of the gaseous fuel valve.

SUMMARY OF THE INVENTION

The present invention provides a valve arrangement for metering fluid flow. The valve arrangement includes a valve seat including an orifice through which fluid flows. The valve arrangement also includes a valve displaceable along an axis between a first position contiguously engaging the valve seat and a second position spaced from the valve seat. Fluid flow between the valve seat and the valve is prevented in the first position and is permitted in the second position. The valve arrangement further includes a counterweight mounted on the valve for relative movement therebetween.

The present invention also provides a fuel injector for metering fuel flow to a combustion chamber of an internal combustion engine. The fuel injector includes a body having an inlet, an outlet, and a fuel flow passage extending along an axis between the inlet and the outlet. The fuel injector further includes a valve seat that is proximate to the outlet and an orifice through which fuel flows. The fuel injector also includes an armature assembly positioned in the passage and displaceable along the axis between first and second positions. The armature assembly includes a valve contiguously engaging the valve seat in the first position to prevent fuel flow through the orifice and spaced from the valve seat in the second position to permit fuel flow through the orifice. The armature assembly also includes a counterweight mounted for relative movement with respect to the armature assembly.

The present invention further provides a method of preventing uncontrolled fuel flow from a fuel injector having an inlet, an outlet, and a fuel flow passage extending along an axis between the inlet and the outlet. The method includes providing a valve seat proximate the outlet. The valve seat includes an orifice through which fuel flows. The method further includes providing an armature assembly displaceable along the axis between first and second positions. The armature assembly includes a valve contiguously engaging the valve seat in the first position to prevent fuel flow through the orifice and being spaced from the valve seat in the second position to permit fuel flow through the orifice.

The method also includes mounting a counterweight on the armature assembly for relative movement therebetween.

BRIEF DESCRIPTION OF DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION

Figure 1:
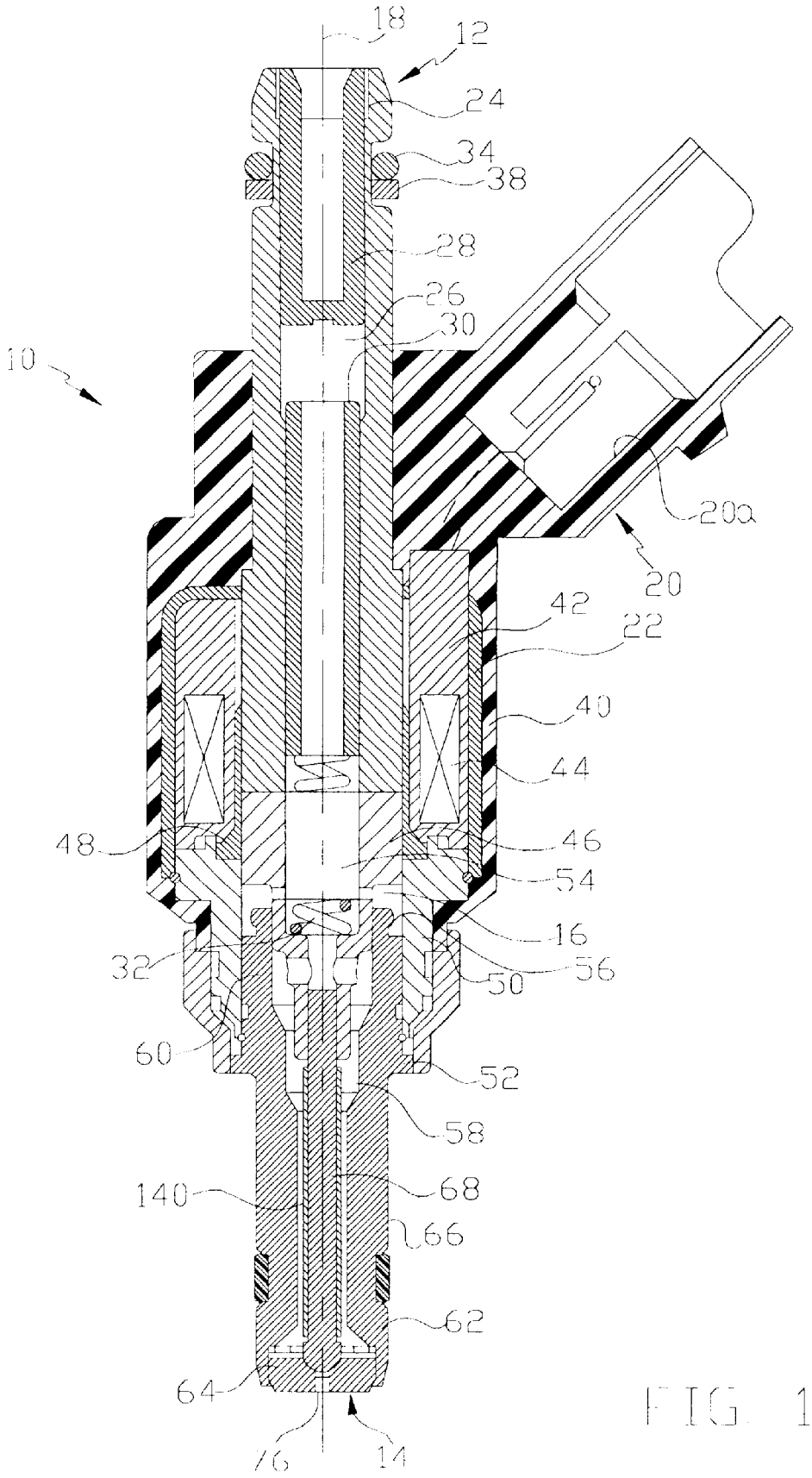
FIG. 1 is a cross-sectional view of a fuel injector according to the invention. The cross-section is taken along a longitudinal axis of the fuel injector.
Figure 2:
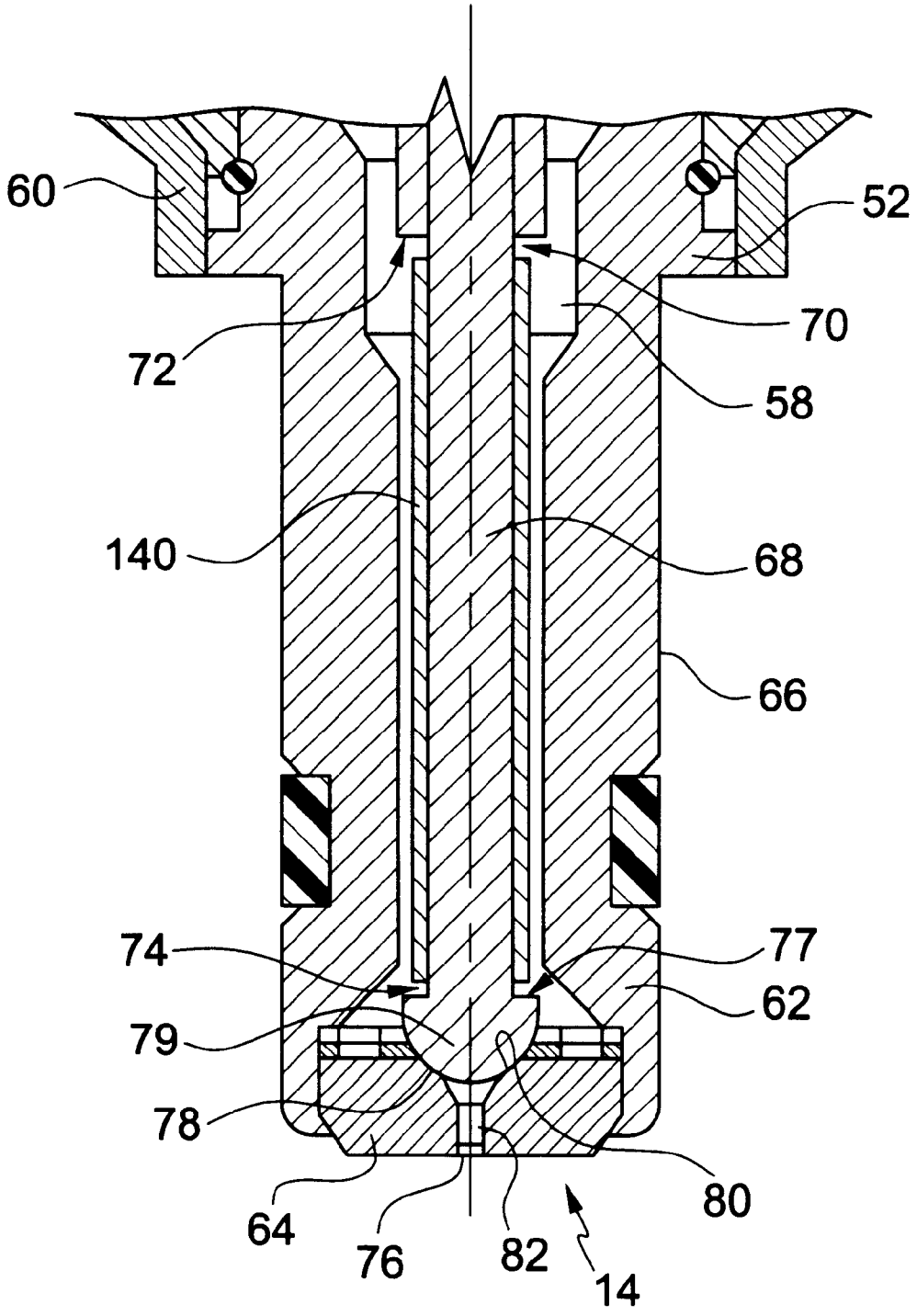
FIG. 2 is an enlarged cross-sectional view of the body of the fuel injector shown in FIG. 1, which illustrates the motion damper of the present invention.

FIG. 1 illustrates a fuel injector 10, which can be a high-pressure, direct-injection fuel injector. The fuel injector 10 has a housing, which includes a fuel inlet 12, a fuel outlet 14, and a fuel passageway 16 extending from the fuel inlet 12 to the fuel outlet 14 along a longitudinal axis 18. The housing includes an overmolded plastic member 20 cincturing a metallic housing member 22.

The overmolded plastic member 20 also cinctures a fuel inlet member 24 having an inlet passage 26. The inlet passage 26 serves as part of the fuel passageway 16 of the fuel injector 10. A fuel filter 28 can be provided in the inlet member 24. An adjustable tube 30 is positionable along the longitudinal axis 18, before being secured with respect to the inlet member 24, to vary the deflection (or compression) of an armature bias spring 32, which contributes to controlling the quantity of fluid flow through the injector. The overmolded plastic member 20 also supports a socket 20a that receives a plug (not shown) to operatively connect the fuel injector 10 to an external source of electrical potential, such as an electronic control unit ECU (not shown). An elastomeric O-ring 34 is provided in a groove on an exterior extension of the inlet member 24. The O-ring 34 is supported by a back up washer 38 to sealingly secure the inlet member 24 with a fuel supply member, such as a fuel rail (not shown).

The metallic housing member 22 encloses a solenoid coil assembly 40. The coil assembly 40 includes a bobbin 42 that retains a coil 44. The ends of the coil 44 are electrically connected via the socket 20*a* of the overmolded plastic member 20. An armature 46 reciprocates in the inlet passage 26 and is aligned along the axis 18 by a spacer 48, a body shell 50, and a body 52. The armature 46 has an armature passage 54 that is aligned along the longitudinal axis 18 and in fluid communication with the inlet passage 26.

The spacer 48 engages the body 52, which is partially disposed within the body shell 50. An armature guide 56 is located at an inlet portion 60 of the body 52. An axially extending body passage 58 connects an inlet portion 60 of the body 52 with an outlet portion 62 of the body 52. The armature passage 54 of the armature 46 is axially aligned with the body passage 58 of the body 52 along the longitudinal axis 18. A seat 64 is located at the outlet portion of the body 62.

Figure 3:
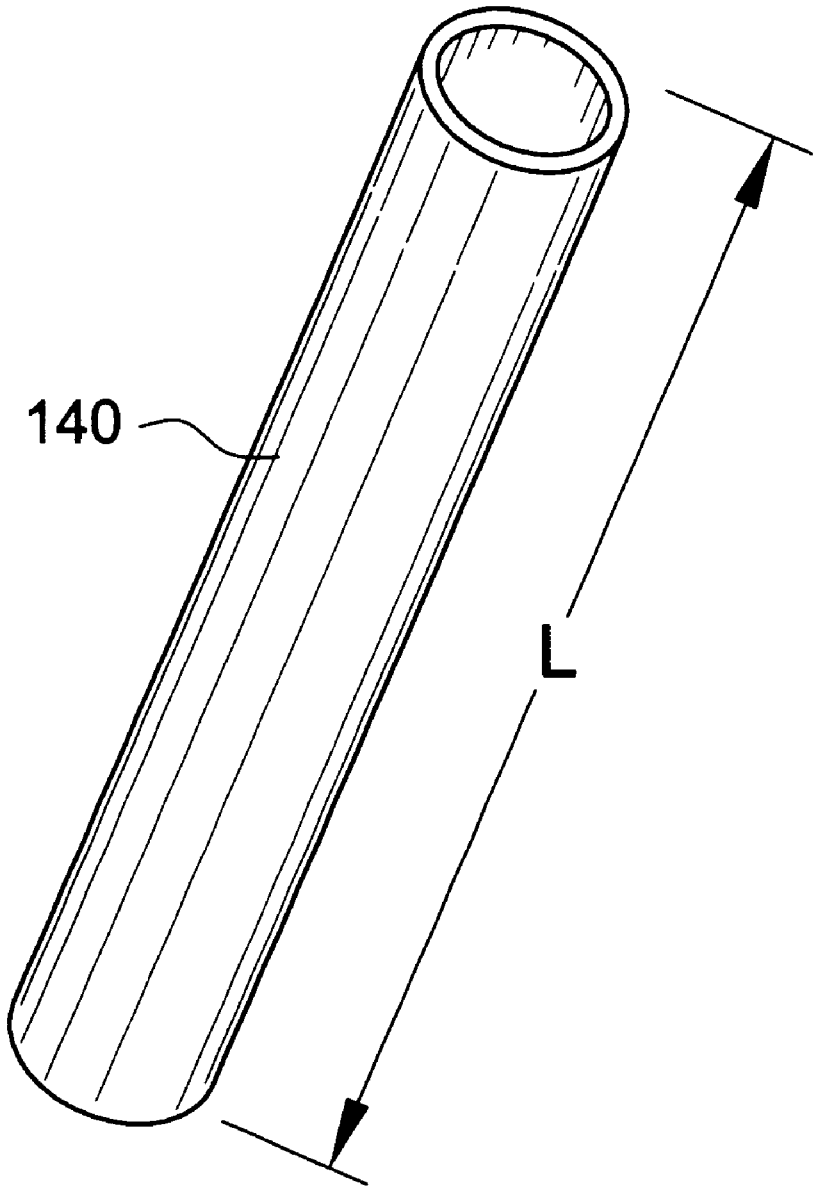
FIG. 3 is a perspective view of the motion damper illustrated in FIG. 2.

The body 52 has a neck portion 66, which is, preferably, a cylindrical annulus that surrounds a needle 68. The needle 68 is fixed to the armature 46, and is preferably, a substantially cylindrical needle 68. The cylindrical needle 68 is centrally located within the neck portion 66 and is axially aligned with the longitudinal axis 18 of the fuel injector 10. A damper 140 is slidingly provided on the needle 68. The length L of the damper 140 is chosen such that when the needle 68 contacts the seat 64, the downward motion of the damper 140 provides a second impact on stop surface 77 of needle tip 79. Thus, an axial clearance 70 is provided between a top surface of the damper 140 and a stop surface 72 of the armature 46, and/or a clearance 74 is provided between a bottom surface of the damper 140 and the stop surface 77 of needle tip 79. As shown in FIG. 3, the damper 140 can include, but is not limited to a cylindrical cross-section.

In operation, an end of the armature 46 that is proximate to the fuel inlet member 24 is magnetically coupled to the adjustable tube 30. A portion of the inlet member 24 that is proximate to the armature 46 serves as a stator for the magnetic circuit that is formed with the armature 46 and coil assembly 40. The armature 46 is guided by the armature guide 56 and is responsive to an electromagnetic force generated by the coil assembly 40 for axially reciprocating the armature 46 along the longitudinal axis 18 of the fuel injector 10. The electromagnetic force is generated by current flow from the ECU through the coil assembly 40. Movement of the armature 46 also moves the attached needle 68 and the motion damper 140. The needle 68 engages the seat 64, which opens and closes the seat passage 76 of the seat 64 to permit or inhibit, respectively, fuel from exiting the outlet 14 of the fuel injector 10. In order to open seat passage 76, the seal between the needle 68 and the seat 64 is broken by upward movement of the needle 68. The needle 68 moves upwards when the magnetic force is substantially higher than it needs to be to lift the armature needle assembly against the force of spring 32 and the pressure of the fuel in the injector 10. This excess magnetic force, which increases exponentially as the armature 46 moves toward the inlet member 24, combined with a relatively light spring preload, high lift, and low viscosity of CNG, all contribute to a high impact velocity between the armature 46 and the inlet member 24. In order to close the seat passage 76 of the seat 64, the magnetic coil assembly 40 is de-energized. In the absence of the magnetic force, the spring 32 preload and the low viscosity CNG both contribute to a high impact velocity between the needle 68 and the seat 64, which can cause the armature needle 46 assembly to rebound, which can produce uncontrolled fuel injection(s). The motion damper 140 is provided to counteract rebound between the armature 46 and the inlet member 24 during valve opening, and to prevent the armature needle assembly from rebounding during the valve closing. For the seat passage 76 opening and the closing states, the motion damper 140, which is slidingly or resiliently mounted on the needle 68, absorbs the energy applied to armature 46 when the armature needle assembly contacts inlet member 24, and when the curved surface 78 of needle 68 contacts conical end 80 of seat 64. It should be noted that the damper 140 can be resiliently mounted to the needle 68 and/or the armature 46 by means of biasing elements (not shown), such as coil springs or rubber bumpers. These biasing elements (not shown) can be located on the needle 68 in the clearance regions 74 and/or 70 between the respective top and bottom surfaces of the damper 140 and the corresponding stop surfaces 72 and 77 on armature 46 and needle tip 79, respectively. For the seat passage 76 opening state, the motion damper 140 abuts against armature 46 and for the seat passage 76 closing state, motion damper 140 abuts against stop surface 77 of needle tip 79. Thus, the motion damper 140 acts as a counterweight to transfer energy, from the impact of armature 46 and inlet member 24 back to armature 46 for the seat passage 76 opening state, and from the impact of needle 68 and seat 64 back to the needle 68 for the seat passage 76 closing state. The curved surface 78 of needle 68 is preferably a spherical surface that mates with a conical end 80 of a funnel 82 that serves as the preferred seat passage 76 of the seat 64. During operation, fuel in fluid communication from the fuel inlet source (not shown) flows through the fuel inlet passage 26, the armature passage 54 of the armature 46, the body passage 58 of the body 52, and the seat passage 76 of the seat 64 to be injected from the outlet of the fuel injector 10.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A valve arrangement for metering fluid flow, the valve arrangement comprising:

a valve seat including an orifice through which fluid flows;

a valve displaceable along an axis between a first position contiguously engaging the valve seat and a second position spaced from the valve seat, wherein fluid flow between the valve seat and the valve is prevented in the first position and is permitted in the second position; and a counterweight mounted on the valve for relative movement therebetween, wherein the relative movement includes the counterweight sliding between first and second configurations with respect to the valve, further comprising:

a first axial clearance between the counterweight and a first member on the valve in the first configuration; and a second axial clearance between the counterweight and a second member on the valve in the second configuration;

wherein an axial length of the counterweight is less than an axial distance between the first and second members.

2. The valve arrangement according to claim 1, wherein the relative movement is parallel to the axis.

3. The valve arrangement according to claim 1, wherein the counterweight encircles the valve.

4. The valve arrangement according to claim 1, further comprising: a resilient element connecting the counterweight to the valve.

5. A fuel injector for metering fuel flow to a combustion chamber of an internal combustion engine, the fuel injector comprising:

a body including an inlet, an outlet, and a fuel flow passage extending along an axis between the inlet and the outlet;

a valve seat proximate the outlet and including an orifice through which fuel flows;

an armature assembly being positioned in the passage and being displaceable along the axis between first and second positions, the armature assembly including:

a valve contiguously engaging the valve seat in the first position to prevent fuel flow through the orifice and being spaced from the valve seat in the second position to permit fuel flow through the orifice; and a counterweight mounted for relative movement with respect to the armature assembly.

6. The fuel injector according to claim 5, wherein the relative movement between the counterweight and the armature assembly is parallel to the axis.

7. The fuel injector according to claim 5, wherein the relative movement includes the counterweight sliding between first and second configurations with respect to the armature assembly.

8. The fuel injector according to claim 7, further comprising:

a first axial clearance between the counterweight and a first stop member on the armature assembly in the first configuration; and a second axial clearance between the counterweight and a second stop member on the armature assembly in the second configuration;

wherein an axial length of the counterweight is less than an axial distance between the first and second stop members.

9. The fuel injector according to claim 5, wherein the counterweight encircles the armature assembly.

10. The fuel injector according to claim 5, wherein the armature assembly further includes:

a resilient element connecting the counterweight to the armature assembly.

11. The fuel injector according to claim 5, further comprising:

a spring biasing the armature toward the first position; and a solenoid drawing the armature toward the second position.

12. A method of preventing uncontrolled fuel flow from a fuel injector having an inlet, an outlet, and a fuel flow passage extending along an axis between the inlet and the outlet, the method comprising:

providing a valve seat proximate the outlet, the valve seat including an orifice through which fuel flows;

providing an armature assembly being displaceable along the axis between first and second positions, the armature assembly including a valve contiguously engaging the valve seat in the first position to prevent fuel flow through the orifice and being spaced from the valve seat in the second position to permit fuel flow through the orifice; and mounting a counterweight on the armature assembly for relative movement therebetween, wherein the mounting includes providing a first axial clearance between the counterweight and the armature assembly in a first relative configuration, and providing a second axial clearance between the counterweight and a member on the armature assembly in a second relative configuration.

13. The method according to claim 12, wherein the mounting includes connecting the counterweight to the armature assembly with a resilient element.

14. A fuel injector for metering fuel flow to a combustion chamber of an internal combustion engine, the fuel injector comprising:

a body including an inlet, an outlet, and a fuel flow passage extending along an axis between the inlet and the outlet;

a valve seat proximate the outlet and including an orifice through which fuel flows;

a coil assembly; and an armature assembly operative to be coupled to the coil assembly, the armature assembly being positioned in the passage and being displaceable along the axis between first and second positions, the armature assembly including:

an armature;

a valve having a first end and a second end extending along the axis, the first end being coupled to the armature, the second end contiguously engaging the valve seat in the first position to prevent fuel flow through the orifice and being spaced from the valve seat in the second position to permit fuel flow through the orifice; and a motion damper mounted on the valve for relative movement with respect to one of the armature and the valve.

* * * * *